US005147119A

United States Patent [19]

Harris

[11] Patent Number: 5,147,119

[45] Date of Patent: Sep. 15, 1992

[54] SOCK STORAGE AND DISPENSING APPARATUS

[76] Inventor: Jonathan L. Harris, 24 Leonard Ave., Leonardo, N.J. 07737

[21] Appl. No.: 544,963

[22] Filed: Jun. 28, 1990

[51] Int. Cl.[5] ..... A47F 1/08

[52] U.S. Cl. ..... 312/49; 211/59.2; 211/59.4; 221/102; 221/303

[58] Field of Search ..... 312/42, 43, 45, 49, 312/71; 221/102, 303, 307, 309, 312, 312 A, 312 C; 248/126; 211/14, 15, 59.2, 59.4, 88, 49.1

[56] References Cited

U.S. PATENT DOCUMENTS

| | | | |
|---|---|---|---|
| 1,714,469 | 5/1929 | Hoffman | 312/45 |
| 1,943,214 | 1/1934 | Dube | 248/126 X |
| 2,155,191 | 4/1939 | Hylton et al. | 312/42 |
| 2,191,511 | 2/1940 | Baff | 312/71 X |
| 2,212,129 | 8/1940 | Rust | 221/307 X |
| 2,221,704 | 11/1940 | Farley | 312/49 |
| 3,549,226 | 12/1970 | Samson | 312/42 |
| 4,042,156 | 8/1977 | Knight | 221/309 X |
| 4,842,149 | 6/1989 | Vining | 312/43 X |

FOREIGN PATENT DOCUMENTS

| | | | |
|---|---|---|---|
| 553410 | 5/1943 | United Kingdom | 221/307 |

*Primary Examiner*—Kenneth J. Dorner
*Assistant Examiner*—Brian K. Green
*Attorney, Agent, or Firm*—Richard A. Joel

[57] ABSTRACT

This invention comprises an apparatus for storing and dispensing socks which includes an elongated tubular member of a predetermined diameter having a slot extending axially therealong and connecting to an enlarged opening at one end of the member where a base is transversely mounted thereto. Rolled socks are deposited into the open end of the tube which is slightly larger than the diameter of the socks and drop downwardly to be supported by the base. The socks are accessible through the opening as needed with the slot used to force the rolled socks downwardly, if stuck, and to provide a viewing of the socks in the tube.

3 Claims, 1 Drawing Sheet

SOCK STORAGE AND DISPENSING APPARATUS

BACKGROUND OF THE INVENTION

The present invention relates to an apparatus for storing and organizing socks and particularly to an apparatus which is relatively inexpensive, easy to use and solves the common problem of sock storage in a most satisfactory manner.

In the prior art various arrangements are available for storing socks but a common problem is still the mixup of socks after laundering, missing socks and a means to readily dispense said socks. No satisfactory solution is known to be on the market and while applicant has not made a search, it is not believed that anticipatory prior art exists. The normal solution to the sock storage problem is the use of various bins or cabinets and the present invention is a distinct improvement thereover. As a further advantage this invention facilitates the dispensing of pairs of matched socks through the use of an inexpensive apparatus which the inventor characterizes as a Sock Tube TM.

SUMMARY OF THE INVENTION

The present invention relates to a sock storage and organizing apparatus and particularly to a new and improved apparatus wherein rolled socks are conveniently stored and readily accessible from a tubular apparatus.

The sock storage and organizing apparatus of the present invention comprises an elongated tubular member of a predetermined diameter mounted to a transverse base at one end so that the apparatus is self-standing. The tubular member includes a slot extending axially therealong which opens to a curved aperture through which the socks are dispensed. The opening includes a lip extending thereacross to prevent the socks from slipping out and to provide additional stiffness to the tubular member.

In operation, rolled up pairs of socks are deposited into the open end of the tubular member and slide downwardly until they encounter either the base of the apparatus or another pair of socks. The axial guide slot provides an opening which shows how many pairs of socks are in the apparatus and also provides a means of pushing the socks downwardly if a pair becomes stuck therein. The socks are dispensed through the opening by manually removing a pair therefrom with the other socks sliding downwardly in a magazine type fashion. The apparatus thus provides an efficient means of storing and organizing socks in a very satisfactory inexpensive manner.

Accordingly, an object of this invention is to provide a new and improved sock storage and organizing apparatus.

Another object of this invention is to provide a new and improved sock storage and organizing apparatus where rolled up socks are organized and accessed from a tubular member in a magazine type fashion.

A more specific object of this invention is to provide a new and improved sock storage and organizing apparatus which includes a tubular storage member mounted on a base and guide means to view and direct the rolled socks to a bottom outlet, said apparatus being inexpensive and extremely efficient.

BRIEF DESCRIPTION OF THE DRAWINGS

The above and other objects and advantages of the present invention may be more clearly seen when viewed in conjunction with the accompanying drawings wherein.

DETAILED DESCRIPTION OF THE INVENTION

Figure 1:
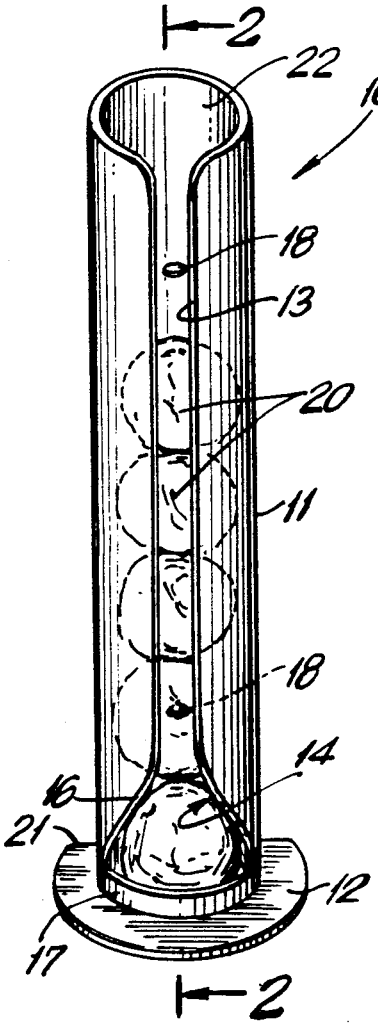
FIG. 1 is a perspective view of the invention.

Referring now to the drawings, the invention 10 as shown in FIG. 1 comprises a tubular member 11 which extends upwardly from a base 12 which is mounted transversely thereto. The tubular member 11 includes an axial slot 13 which leads to an opening 14 towards the base 12. The opening 14 includes rounded side portions 16 which extend outwardly from the main slot 13 and a lip 17 extending along the base 12 from one side 16 of the opening 14 to the other. The lip 17 is provided for stiffness and to prevent the socks from spilling out from a magazine-like tube 11. The apparatus 10 also includes two keyhole slots 18 which may be used to hang the apparatus 10 from a wall or hook of some type. The rear portion 21 of the substantially circular base 12 is cut off in a plane which is substantially parallel to a plane along the slot 13 and is itself tangent to the rear of the tube 11. This makes it possible to hang the apparatus 10 through slot 18 in a flush position against a wall (not shown).

Figure 2:
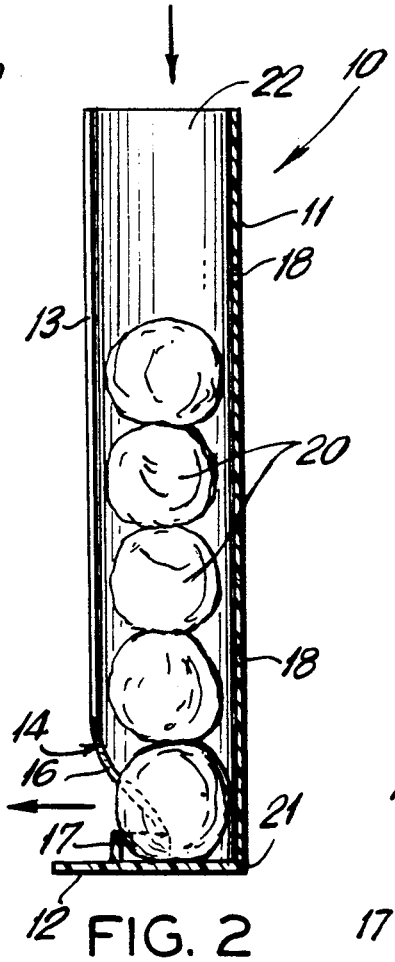
FIG. 2 is a view of the invention taken along line 2—2 of FIG. 1

The tube 11 may be made of plastic which is a preferable material and may be transparent or colored as desired. The tubular member 11 accommodates rolled up socks 20 which are shown in the drawings. The diameter of the tubular member 11 is slightly larger than the rolled up socks 20 so that the socks 20 slide down the tube 11 to be engaged eventually by the base 12. The socks are removed through the opening 14 in the direction of the arrow in FIG. 2. The use of rolled socks has the further advantage that the socks 20 only have to be mated once, for example, after laundering.

Figure 3:
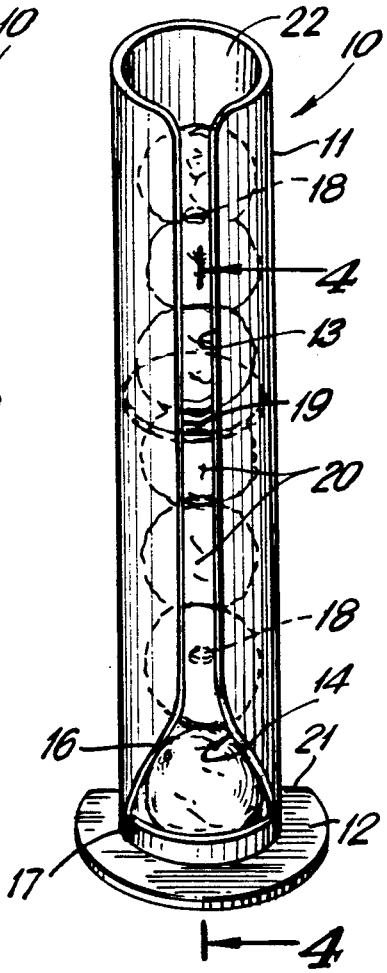
FIG. 3 is a perspective view of the invention illustrating the use of a sock separator.
Figure 4:
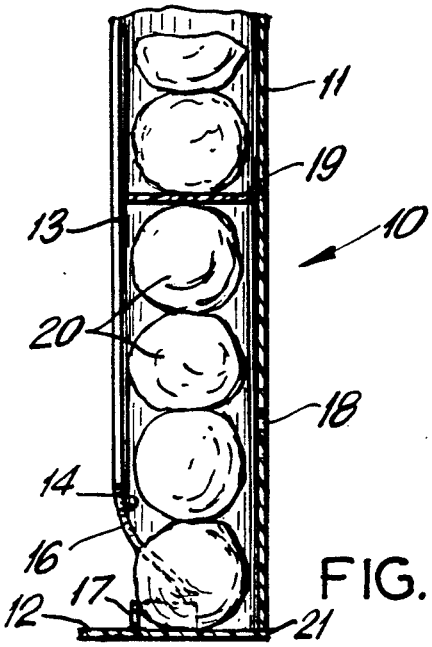
FIG. 4 is a view of the invention taken along the lines of 4—4 of FIG. 3.

The apparatus may also be used in conjunction with a guide separator 19, as shown in FIG. 3, which is used to separate clean from dirty socks or different types of socks. Of course, the separator 19 which is dimensioned so as to slide within the tubular member may be used between each and every pair of socks 20 if so desired. The apparatus may also be hung from hooks or otherwise suspended by means of the aperture 18 as noted above.

In use, the socks 20 are deposited into the opening 22 at the top portion of the tubular member and move downwardly within the tubular member 11 until they either hit the base 12 or another pair of rolled up socks 20 or the separator 19. The number of socks to be stored depends upon the length of the tubular member 11 and, of course, the bulkiness of the socks. If the socks 20 are to stick within the tubular member 11, the guide slot 13 may be used to move them downwardly. The guide slot 13 also functions as a viewing mechanism so that one can see the number of socks that are in the apparatus 10. The invention as thus described provides a ready, simple and inexpensive storage means for socks which eliminates much of the hassle and problems asserted with sock storage and organization. The apparatus 10 itself is also attractive and may come in various colors, materials and decorative effects.

It is to be understood that the above-described arrangements are merely illustrative examples of the application. Numerous other arrangements may be readily devised by those skilled in the area which will embody the principles of the invention and fall within the spirit and scope thereof.

What is claimed is:

1. An integral plastic sock storage and organizing apparatus wherein rolled socks are stored and accessed comprising:

an elongated tubular member having an upper portion and a lower portion including an axial slot extending therealong for viewing the stored socks, said slot flairing outwardly for a substantial distance and downwardly at the lower portion to form a sock dispensing opening, a base attached across an end of the tubular member to make the apparatus self-standing, and, a lip having ends, the lip mounted on the base and extending solely across the opening and having the lower portion of the tubular member joined to the ends of the lip, to provide additional stiffness to the tubular member and to prevent the socks from spilling out from said tubular member.

2. An apparatus in accordance with claim 1 further including:

an opening in the upper portion of the tubular member directly opposite the slot for mounting said member to a surface and wherein the base comprises a substantially circular member extending outwardly from the tubular member and having a portion parallel to the plane of the slot comprising a flat transverse surface so that the apparatus may be mounted flush against a surface.

3. An apparatus in accordance with claim 2 further including:

a separator comprising a disc-like member having a diameter slightly smaller than the diameter of the tube so that the separator is slidable therein to separate socks within said tubular member.

* * * * *